US007314020B2

(12) United States Patent
Corker et al.

(10) Patent No.: US 7,314,020 B2
(45) Date of Patent: Jan. 1, 2008

(54) OVER-HEIGHT VEHICLE BARRIERS

(76) Inventors: Bill Corker, c/o Denton Corker Marshall, 49 Exhibition Street, Melbourne, Victoria (AU) 3000; Garry Whytcross, c/o Hyder Consulting, Level 16, 31 Queen Street, Melbourne, Victoria (AU) 3000; John Howell, 45 Outlook Drive, Eaglemont, Victoria (AU) 3084

( * ) Notice: Subject to any disclaimer, the term of this patent is extended or adjusted under 35 U.S.C. 154(b) by 0 days.

(21) Appl. No.: 10/538,180

(22) PCT Filed: Dec. 9, 2003

(86) PCT No.: PCT/AU03/01648

§ 371 (c)(1),
(2), (4) Date: Apr. 26, 2006

(87) PCT Pub. No.: WO2004/053234

PCT Pub. Date: Jun. 24, 2004

(65) Prior Publication Data

US 2007/0006793 A1 Jan. 11, 2007

(30) Foreign Application Priority Data

Dec. 10, 2002 (AU) ..... 2002953249

(51) Int. Cl.
*E01F 9/00* (2006.01)
*G09F 7/22* (2006.01)

(52) U.S. Cl. ..... 116/63 R

(58) Field of Classification Search ..... 116/28 R, 116/63 R; 40/612; 246/473 R, 486; 404/10
See application file for complete search history.

(56) References Cited

U.S. PATENT DOCUMENTS

| | | | | | |
|---|---|---|---|---|---|
| 726,348 | A | * | 4/1903 | Richardson | 246/486 |
| 770,036 | A | * | 9/1904 | Allen | 246/486 |
| 810,041 | A | * | 1/1906 | Donaldson | 246/486 |
| 1,360,992 | A | * | 11/1920 | Strimple | 246/486 |
| 1,454,753 | A | * | 5/1923 | McGhee | 246/473 R |
| 1,491,636 | A | * | 4/1924 | Sanfacon | 40/606.15 |
| 1,649,748 | A | * | 11/1927 | Scott | 160/4 |
| 1,669,695 | A | * | 5/1928 | Devereux | 116/28 R |

(Continued)

FOREIGN PATENT DOCUMENTS

FR 2 768 447 A 3/1999

*Primary Examiner*—Alexander R. Smith
(74) *Attorney, Agent, or Firm*—Harness, Dickey & Pierce, PLC

(57) ABSTRACT

An over-height vehicle barrier has a supporting beam mounted above a carriageway, with multiple blade-like members rotatably mounted to the supporting beam such that the blade-like members are suspended downwardly from the beam in parallel relationship and in close proximity one to another. A leading edge of each member faces oncoming traffic on the carriageway for possible engagement by an over-height vehicle such that each member can rotate about the axis of the beam independently of the other members when struck by an over-height vehicle. A further beam is engageable by the rotating members when struck by a vehicle to limit the extent of rotation about the axis of the beam and to thereby cause the members to rotate in a return direction. Engagement of the members by a vehicle generates a warning noise to alert the driver of the vehicle and the further beam itself can generate further additional noise when engaged by the rotating members.

9 Claims, 4 Drawing Sheets

U.S. PATENT DOCUMENTS 1,781,675 A * 11/1930 Campbell ..... 246/486
1,808,692 A * 6/1931 Sudduth ..... 40/612
2,456,849 A * 12/1948 Waters ..... 116/63 R
3,009,026 A * 11/1961 Bonanno ..... 191/29 R
4,346,666 A 8/1982 Iso ..... 116/63 R
5,474,016 A 12/1995 Haney ..... 116/28 R
5,888,016 A * 3/1999 Ahn ..... 404/10
2002/0178994 A1 * 12/2002 Fernandez Marin ..... 116/63 R

* cited by examiner

OVER-HEIGHT VEHICLE BARRIERS

CROSS-REFERENCE TO RELATED APPLICATIONS

This Application is a U.S. National Stage of International Application No. PCT/AU2003/001648 filed 09 Dec. 2003 and published in English as WO 2004/053234 A1 on 24 Jun. 2004. This Application claims the benefit of Australian Application No. 2002953249, filed 10 Dec. 2002. The disclosures of the above applications are incorporated herein by reference.

The present invention relates to over-height vehicle barriers for installation in advance of a road tunnel, a bridge or other structure where vehicle height limitations apply.

It is common practice to install on a roadway in advance of a tunnel, a bridge, or other structure where a height limitation applies, a over-height barrier which will be contacted by an over-height vehicle before the vehicle actually reaches the height-restricted zone of the tunnel, bridge or other structure.

One prior form of over-height vehicle barrier consists of a heavy beam rigidly mounted, the objective of the beam being to physically stop the over-height vehicle before it comes into contact with the structure being protected. This is not particularly satisfactory as engagement with the beam can result in part of an over-height load being dislodged into the path of other vehicles and also engagement with the beam may cause the vehicle to stop very suddenly, also presenting a danger to following vehicles and vehicles in adjacent lanes. When the beam is struck, its supporting structure will be subject to substantial impact loading; as, sometimes, such beams are mounted directly to a bridge or tunnel entrance, some damage may still result to the structure intended to be protected.

A variation of the fixed rigid beam over-height barrier is a sliding beam barrier consisting of a heavy beam mounted on rails which enable the beam to be pushed in the direction of traffic flow by an over-height vehicle. The vertical clearance between the rails and the road increases so that as the beam is pushed further along the rails the extent of interference is diminished. However if the vehicle is higher than the beam clearance at the far end of its travel, the results will be similar to those experienced using the fixed rigid beam as discussed above. In addition, due to the weight of the beam it is still possible for the beam to dislodge part of the vehicle's load into the path of other vehicles.

Another prior form of over-height barrier comprises a heavy beam or weights suspended by chains or cables from a supporting structure. This is also unsatisfactory in some situations, as there is a risk that part of the load might become entangled within the chains or cables if the load is excessively high as may arise with a carrier for earth-working machinery having a long boom arm which can extend to a substantial height even when parked for transportation. This may result in parts of the barrier including its supporting structure being damaged or dislodged. Also, again, due to the weight of the barrier, part of the over-height load of the vehicle may become dislodged into the path of other vehicles.

According to the present invention there is provided an over-height vehicle barrier, said barrier having a series of over-height vehicle engaging members mounted in closely-spaced relationship on a supporting beam mounted above a carriageway such that each member hangs beneath the beam for possible engagement by an over-height vehicle, each member being pivotally mounted to the beam at an upper end portion thereof such that each member can pivot about the axis of the beam independently of the other members when struck by an over-height vehicle, and a further beam spaced from the supporting beam to be engaged by said members pivoting about the supporting beam when struck by an over-height vehicle and to thereby cause the members to pivot in a return direction, engagement of said members by a vehicle generating a warning noise to alert the driver of the vehicle.

In a preferred embodiment of the invention each of the engaging members is in the form of a blade with substantially flat parallel sides, the blade preferably being of downwardly tapering profile when viewed from the side.

Advantageously the supporting beam is of circular cross section to provide a direct pivotal mounting for each blade.

The blades are each of a semi-rigid structure capable of deforming upon impact to absorb energy. In one preferred form, the blades are composed of polyurethane.

The further beam against which the blades impact is preferably a gantry beam from which the supporting beam is rigidly mounted so that the supporting beam lies beneath the gantry beam. The gantry beam is preferably a tube of circular section so that when impacted by the pivoting blades the gantry beam will generate a loud resonant noise.

Further according to the invention there is provided an over-height vehicle barrier, said barrier having a series of over-height vehicle engaging members mounted in closely-spaced relationship on a supporting beam mounted above a carriageway such that each member hangs beneath the beam for possible engagement by an over-height vehicle, each member being mounted to the beam at an upper end portion thereof by a rotary bearing arrangement such that each member can swing about the axis of the beam independently of the other members when struck by an over-height vehicle, and a further beam spaced above the supporting beam to be engaged by said members swinging about the supporting beam when struck by an over-height vehicle and to thereby cause the members to swing in a return direction, engagement of said members by a vehicle generating a warning noise to alert the driver of the vehicle.

Still further according to the invention there is provided an over-height vehicle barrier, said barrier having a series of over-height vehicle engaging members mounted in closely-spaced relationship on a supporting beam of circular cross-section mounted above a carriageway such that each member hangs beneath the beam for possible engagement by an over-height vehicle, each member being mounted to the beam by a rotary bearing at an upper end portion of the member such that each member can swing about the axis of the beam independently of the other members when struck by an over-height vehicle, and means spaced from the supporting beam to be engaged by said members swinging about the supporting beam when struck by an over-height vehicle and to thereby cause the members to swing in a return direction, each said member being composed of a material which is resiliently deformable when struck by an over-height vehicle to absorb energy upon impact, engagement of said members by a vehicle generating a warning noise to alert the driver of the vehicle.

Still further according to the invention there is provided an over-height vehicle barrier, said barrier having a supporting beam mounted above a carriageway, multiple blade-like members rotatably mounted to the supporting beam such that the blade-like members are suspended downwardly from the beam with the members being arranged in parallel relationship in close proximity one to another with a leading edge of each member facing oncoming traffic on the carriageway for possible engagement by an over-height vehicle such that each blade-like member can rotate about the axis of the beam independently of the other members when struck by an over-height vehicle, and means engageable by the rotating members when struck by a vehicle to limit the extent of rotation about the axis of the beam and to thereby cause the members to rotate in a return direction, each said member being composed of a material which is resiliently deformable when struck by an over-height vehicle to absorb energy upon impact, engagement of said members by a vehicle generating a warning noise to alert the driver of the vehicle.

An embodiment of the invention will now be described by way of example only with reference to the accompanying drawings in which.

Figure 2:
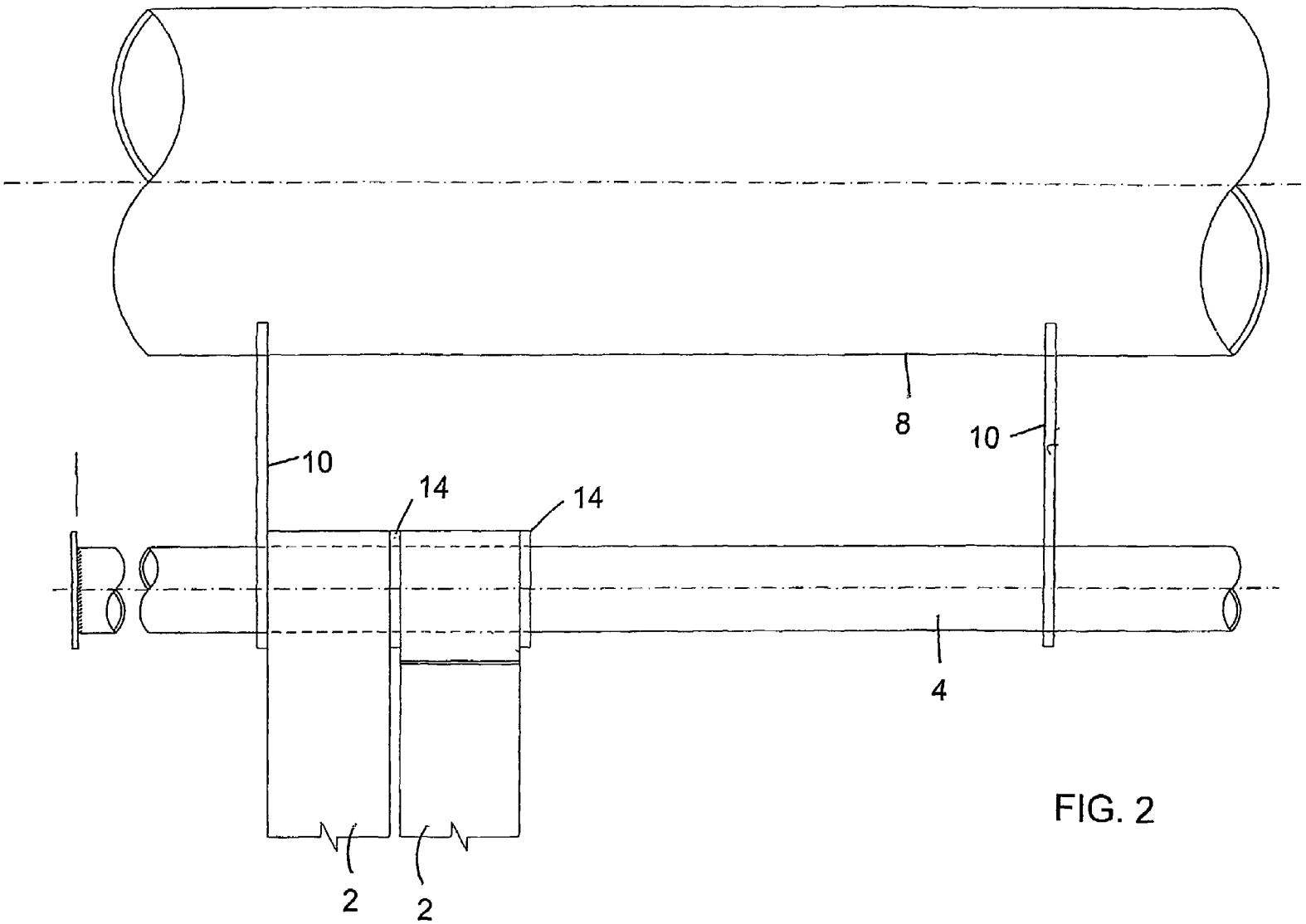
FIG. 2 is a front view to an enlarged scale showing part of the structure of the barrier including supporting beam, pivotal or swinging blades mounted from the supporting beam, and a gantry beam which carries the supporting beam.
Figure 3:
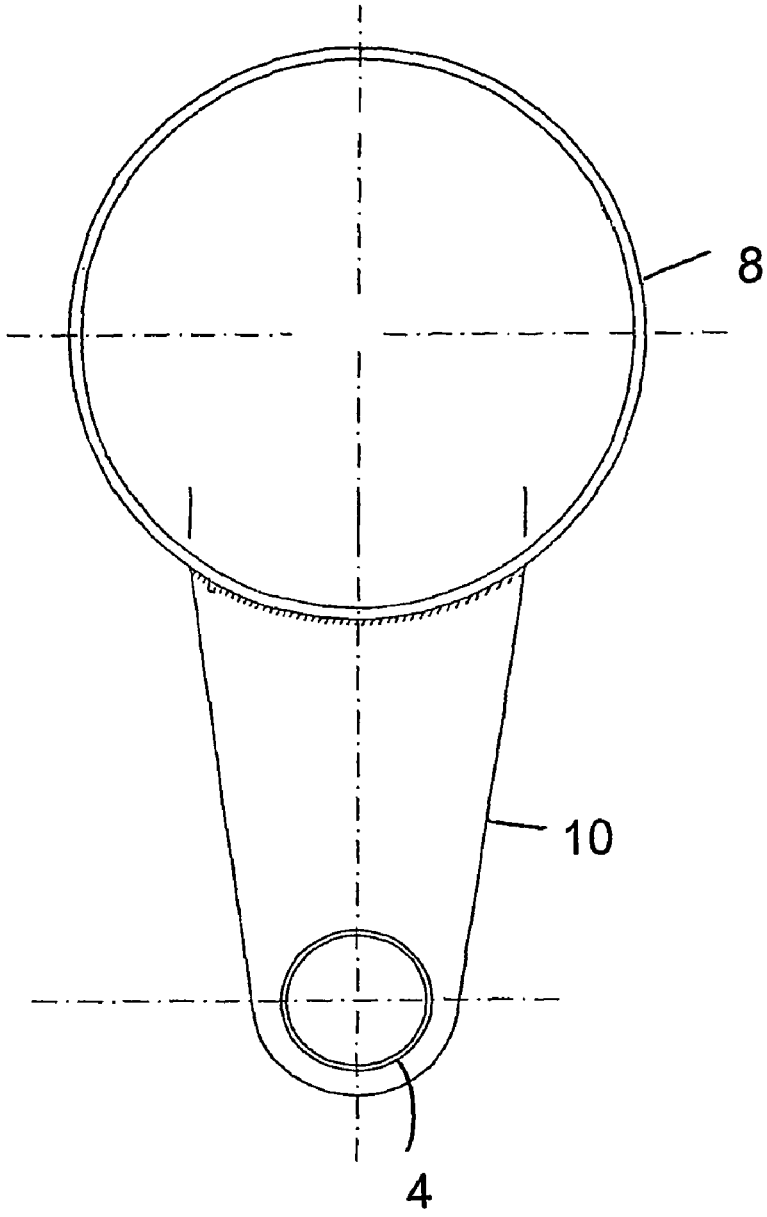
FIG. 3 is a side view showing the gantry beam and hanger plates by which the supporting beam is mounted from the gantry beam.

The over-height vehicle barrier in accordance with the preferred embodiment of the invention comprises a series of separate blades 2 mounted in closely-spaced relationship along the length of a supporting beam 4 (see FIG. 2) in such a manner as to enable the blades 2 individually to freely pivot or swing about the axis of the supporting beam 4. For this purpose, in the preferred embodiment, the supporting beam 4 consists of a rigid metal tube of circular cross section on which each blade 2 is rotatably mounted by a suitable bearing arrangement 6 within the upper end portion of the blade 2 and through which the tube extends. The supporting beam 4 itself is carried from a gantry beam 8 by hanger plates or struts 10 welded to the gantry beam 8 and extending downwardly from the gantry beam 8 so that supporting beam 4 is located beneath the gantry beam 8 and is vertically spaced therefrom. The depth of the supporting beam 4 beneath the gantry beam 8 is such that the presence of the gantry beam 8 inhibits complete rotation of the blades 2 about the supporting beam 4 for reasons to be described subsequently. The gantry beam 8 is itself preferably also a tubular beam of circular cross section.

Figure 1:
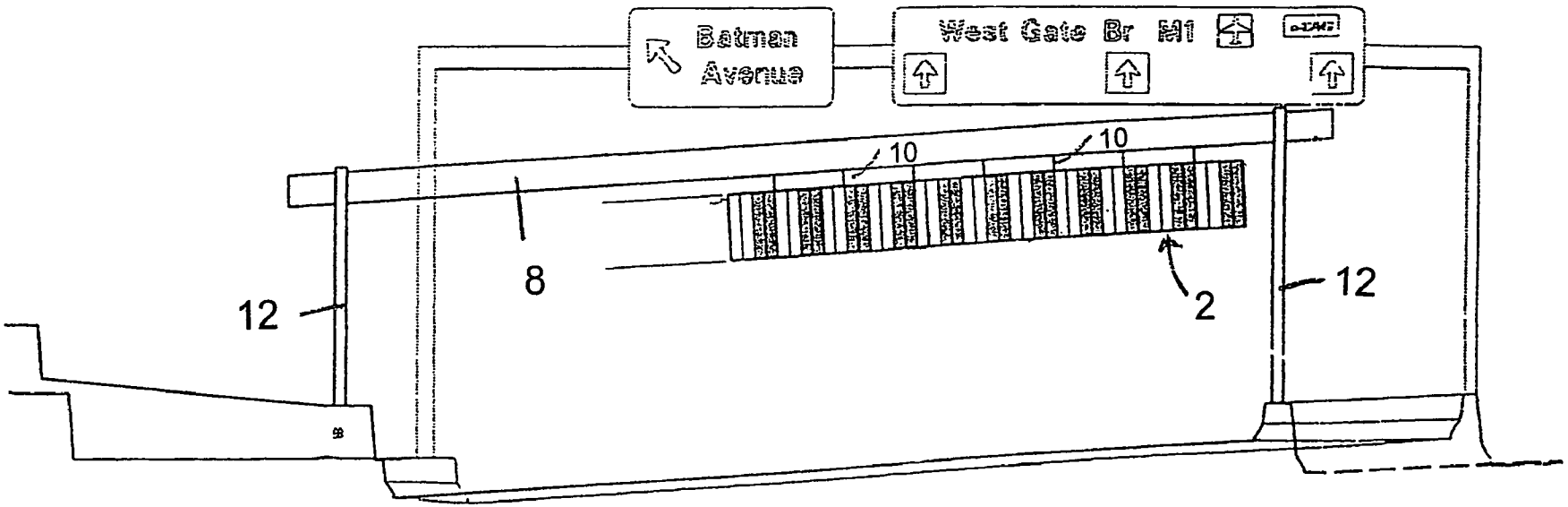
FIG. 1 shows schematically an over-height vehicle barrier installed above a carriageway.

In the particular configuration shown in FIG. 1, only some of the lanes of the carriageway require over-height protection and the beam 4 with blades 2 is only positioned above those lanes, whereas the gantry beam 8 spans the entire carriageway and is supported at each end by posts 12. Other supporting structure for the gantry beam 8 can alternatively be provided and it will be understood that the actual configuration of the beam 4 with blades 2 in relation to the carriageway will be determined by the over-height protection to be provided on a site-by-site basis.

Figure 4:
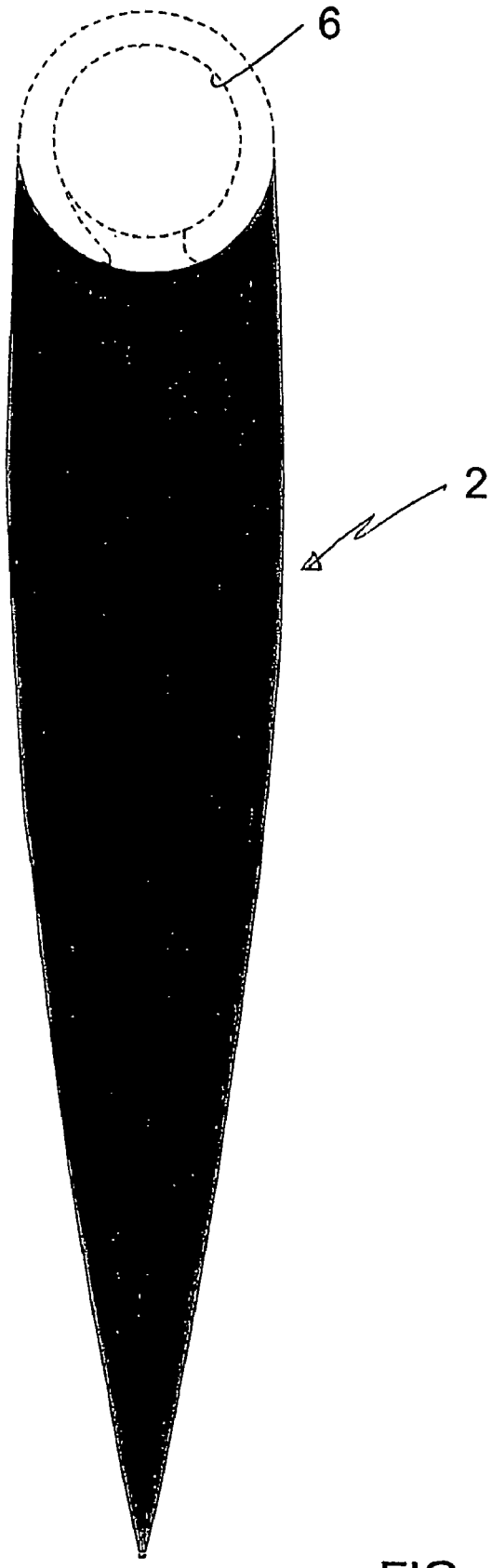
FIG. 4 is a side view to a further enlarged scale showing one of the blades.

Each of the blades 2 is of a constant width when viewed from the front of the barrier (see FIGS. 1 and 2) with flat parallel sides and tapers towards its lower end when viewed from the side as shown in FIG. 4, with the leading edge of each blade facing in the direction of the oncoming traffic. Preferably the blades are formed of a semi-rigid plastics material such as polyurethane with a structure which enables the blade to deform and absorb energy when struck by an over-height part of a vehicle travelling through the barrier.

Each blade 2 has a substantial length, for example between 1.3 and 1.5 meters so as to provide a substantial projection beneath the supporting beam 4. Accordingly, the beam 4 can be mounted at such a height above the carriageway that the likelihood of that beam being struck even by a load which is excessively over-height is extremely small.

As discussed above, each blade 2 is of substantially constant width when viewed from the front of the barrier and the blades 2 are mounted in closely spaced relationship along the length of the beam 4, being separated for example by washers 14. Accordingly, when viewed by the driver of an approaching vehicle, the array of closely spaced blades 2 itself gives the appearance of a solid beam and this sense can be increased by differently colouring adjacent groups of blades in contrasting colours, typically black and yellow, to give the impression of vertical warning stripes along the length of the seemingly solid beam as shown in FIG. 1.

In the event that the barrier is struck by an over-height vehicle, which could be travelling at speeds up to 80 km/hr, the leading edges of those blades 2 engaged by the over-height part of the vehicle will be struck with a high impact force and will swing upwardly around the supporting beam 4 at relatively high velocity to engage the rear side of the gantry beam 8. Upon engagement with the gantry beam 8, the blades 2 will be deflected downwardly in the reverse direction. The actions which have just been described will typically take place within a fraction of a second. If the over-height part is of sufficient length the blades may be re-engaged and swung against the gantry beam 8 one or more further times. The initial impact of the vehicle with the blades 2 will generate noise as will any subsequent impact following deflection by the gantry beam 8. The gantry beam 8 itself, being hollow, will also generate substantial noise when struck by the swinging blades 2. Accordingly, engagement of the vehicle with the blades 2 will create a significant impact noise which should suggest to the driver that significant impact damage may have arisen thereby inducing the driver to stop. However, due to the semi-rigid nature of the structure of the blades 2 and the mounting of the blades 2 on the supporting beam 4 for free pivotal movement, engagement of the blades 2 by the vehicle will be unlikely to dislodge part of its load into the path of other vehicles even if the over-height part causes several return impacts on the blades 2. Moreover the barrier, although providing a very loud and distinct warning which should induce the driver to stop, will not actually stop the vehicle itself with consequential risk of collision with other vehicles. When the vehicle has stopped beyond the barrier, it is then able to be reversed back through the barrier, with the blades 2 then being pivoted upon engagement with the over-height part in the reverse direction to permit passage of the vehicle. Under these conditions the vehicle will be travelling quite slowly and engagement of the blades with the over-height part will simply allow the blades to lift and allow passage of the vehicle.

The barrier described also permits the passage of authorised over-height vehicles to pass through the barrier under permitted and controlled conditions.

Although the configuration just described particularly convenient and is effective and is the preferred configuration, nevertheless in alternative configurations, the swinging blades, instead of engaging a gantry beam which limits their rotation and causes movement in the return direction, the blades could alternatively engage other structure having a similar function, for example a tensioned cable. Although the tensioned cable will not generate the resonant noise which would be typical of a hollow metal beam when struck, nevertheless significant noise will still be generated by impact of the vehicle with the blades both initially and on their return movement.

The blades must be of robust construction to withstand repeated impact with vehicles while being capable of deflection to absorb energy upon impact. The blades should also be of relatively light weight to reduce centrifugal and inertial forces on impact to prevent dislodging of part of the load and also to prevent damage to the supporting structure. Blades constructed principally from polyurethane are suitable for this purpose. The bearing arrangement 6 and associated structure incorporated into the upper part of the blade 2 as an integral part during manufacture is such as to permit the blades 2 individually to be removed and replaced on the supporting beam 4 with the beam 4 remaining in situ.

The embodiment has been described by way of example and modifications are possible within the scope of the invention.

The invention claimed is:

1. An over-height vehicle barrier, said barrier having a series of over-height vehicle engaging members mounted on a supporting beam mounted above a roadway such that each member hangs beneath the supporting beam for possible engagement by an over-height vehicle, each member being pivotally mounted to the supporting beam at an upper end portion thereof such that each member can pivot about the axis of the beam independently of the other members when struck by an over-height vehicle, and a second beam spaced from the supporting beam to be engaged by said members pivoting about the supporting beam when struck by an over-height vehicle and to thereby cause the members to pivot in a return direction, wherein engagement of said members by a vehicle generates a warning noise to alert the driver of the vehicle, and wherein each of the members is in the form of a blade having opposed sides and a relatively narrow leading face towards the oncoming traffic, the members being mounted with the adjacent sides of adjacent members being in closely spaced relationship whereby the series of vehicle engaging members provides the appearance of a solid beam facing the oncoming traffic.

2. A barrier according to claim 1, wherein the supporting beam is of circular cross section and provides a direct pivotal mounting for each blade.

3. A barrier according to claim 2, wherein the blades are each of a semi-rigid structure capable of deforming upon impact to absorb energy.

4. A barrier according to claim 3, wherein the second beam which the members impact is a tube of circular cross-section mounted above the supporting beam and spaced therefrom so that when impacted by the pivoting members a loud resonant noise will be generated.

5. A barrier according to claim 1, wherein the second beam which the members impact is a tube of circular cross-section mounted above the supporting beam and spaced therefrom so that when impacted by the pivoting members, a loud resonant noise will be generated.

6. A barrier according to claim 5, wherein the second beam comprises a gantry beam from which the supporting beam is rigidly mounted.

7. An over-height vehicle barrier, said barrier having a supporting beam mounted above a roadway, multiple blade-like members suspended downwardly from the beam with the members being arranged in parallel relationship with a relatively narrow leading face of each member facing oncoming traffic on the roadway for possible engagement by an over-height vehicle such that each member can rotate about the axis of the beam independently of the other members when struck by an over-height vehicle, the blade-like members having opposed sides and being mounted with the adjacent sides of adjacent members in close proximity one to another whereby to provide the appearance of a solid beam facing the oncoming traffic, and means engageable by the rotating members when struck by a vehicle to limit the extent of rotation about the axis of the beam and to thereby cause the members to rotate in a return direction, each said member being composed of a material which is resiliently deformable when struck by an over-height vehicle to absorb energy upon impact, and wherein engagement of said members by a vehicle generates a warning noise to alert the driver of the vehicle.

8. A barrier according to claim 7, wherein each member has substantially flat parallel opposed sides and is of a downwardly tapering profile when viewed from the side.

9. An over-height vehicle barrier, said barrier having a supporting beam mounted above a roadway, multiple members rotatably mounted to the supporting beam such that the members are suspended downwardly from the beam with the members having substantially flat parallel opposed sides and being arranged in parallel relationship with a relatively narrow leading face of each member facing oncoming traffic on the roadway for possible engagement by an over-height vehicle such that each member can rotate about the axis of the beam independently of the other members when struck by an over-height vehicle, the members being mounted with the adjacent sides of adjacent members in close proximity one to another whereby to provide the appearance of a solid beam facing the oncoming traffic, and a second beam spaced above the supporting beam to be engageable by the rotating members when struck by a vehicle to limit the extent of rotation about the axis of the supporting beam and to thereby cause the members to rotate in return direction, each said member being composed of a material which is resiliently deformable when struck by an over-height vehicle to absorb energy upon impact, and the second beam being of tubular form so as to generate a loud resonant noise when impacted by the rotating members.

* * * * *